US006910611B2

(12) United States Patent
Chi

(10) Patent No.: US 6,910,611 B2
(45) Date of Patent: Jun. 28, 2005

(54) APPARATUS FOR ADJUSTING WIDTH OF DRIVE CHANNEL OF NAILER

(75) Inventor: Lai Chun Chi, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 10/642,834

(22) Filed: Aug. 18, 2003

(65) Prior Publication Data

US 2005/0040204 A1 Feb. 24, 2005

(51) Int. Cl.[7] ..... B25C 3/00
(52) U.S. Cl. ..... 227/109; 227/119; 227/120
(58) Field of Search ..... 227/109, 119, 120, 227/123, 125, 128, 130, 135

(56) References Cited

U.S. PATENT DOCUMENTS 4,304,349 A * 12/1981 Novak et al. ..... 227/109
4,688,710 A * 8/1987 Massari et al. ..... 227/109
4,746,046 A * 5/1988 Frye ..... 227/120
5,197,647 A * 3/1993 Howell ..... 227/126
5,297,713 A * 3/1994 Perra et al. ..... 227/123
6,290,115 B1 * 9/2001 Chen ..... 227/120

* cited by examiner

*Primary Examiner*—Louis K. Huynh
*Assistant Examiner*—Nathaniel Chukwurah
(74) *Attorney, Agent, or Firm*—Charles E. Baxley

(57) ABSTRACT

An apparatus for adjusting width of drive channel of nailer has a slot defined at a side surface of a track of the channel assembly, in the slot are defined a plurality of recesses and an adjustable push plate a plurality of blocks are defined on the push plate, the width of track can be increased when the blocks are inserted in the respective recesses, and alike, the width of track can be reduced when the blocks abut against the internal surface of the slot. By such a manner, the apparatus of the present invention is capable of providing suitable drive channel for different sized nails.

3 Claims, 7 Drawing Sheets

APPARATUS FOR ADJUSTING WIDTH OF DRIVE CHANNEL OF NAILER

FIELD OF THE INVENTION

The present invention relates to a nailer, and more particularly to an apparatus for adjusting width of drive channel of a nailer for providing well-matched drive channels for vary sized nails.

DESCRIPTION OF THE PRIOR ARTS

The width of drive channel of a conventional nailer is normally fixed, although the channel assembly is applicable to different sized band of nails with an assistance of a pushing device, however, the smaller nails are difficult to be fixed rigidly. With reference to FIG. 1, a conventional channel assembly 10 is interiorly defined with a track 11 for passage of nails 12. The track 11 is able to accommodate different sized nails 12 by cooperating with a pushing device, however, due to the width of the track 11 is unadjustable, inevitably, the width of the track should be large enough to receive the largest nails 12. In this case, when smaller nail 12 is loaded in the relative large sized track 11, the base body of the small nail 12 is likely to sway during the nail-positioning and pushing course, meanwhile, other problems are possibly caused in operation (such as unstable operation of nails pushing, broken and jam of nails, and the noises arisen in the nailing operation).

The present invention has arisen to mitigate and/or obviate the afore-described disadvantages of the conventional drive channel assembly of a nailer.

SUMMARY OF THE INVENTION

The primary object of the present invention is to provide an apparatus for adjusting width of drive channel of a nailer so as to provide a best-matched drive channel for different sized nails. At a side of a track of the channel assembly is slidably provided a push plate which is adjustable to position different sized nails, and the width of the track can be increased when a plural blocks of the push plate engage a plurality of recesses in the channel assembly, vice versa, the width of the track can be reduced when the plural blocks of the push plate abut against the internal surface of the channel assembly.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENT

Figure 1:
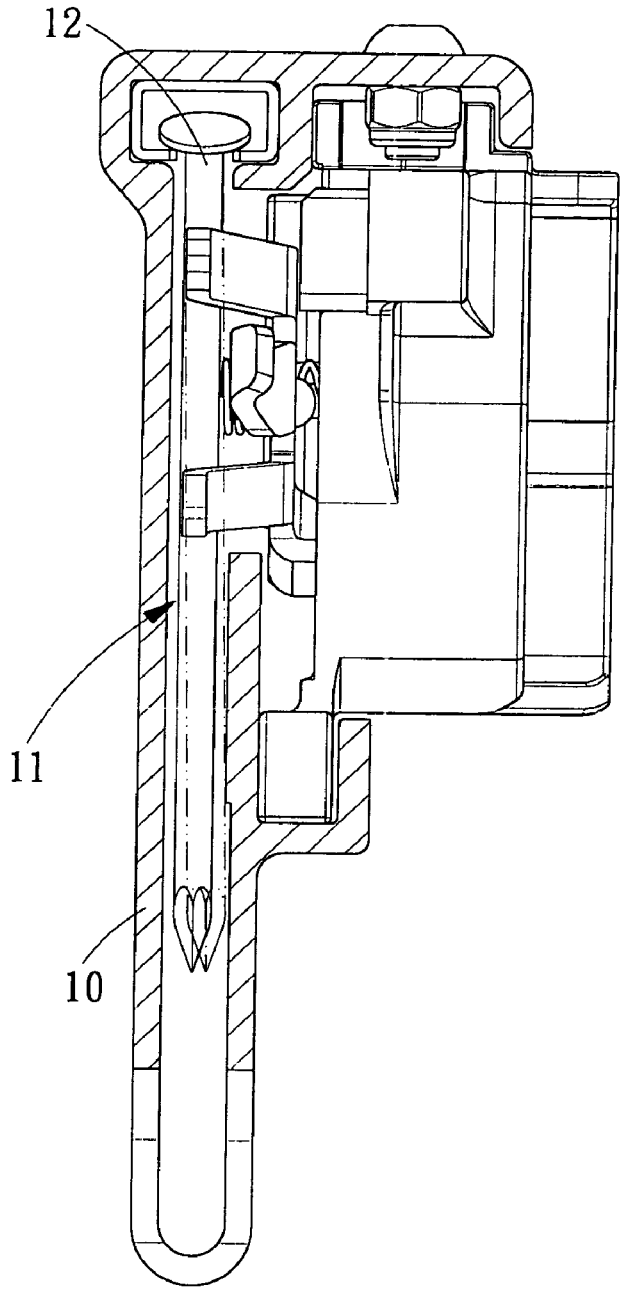
F I G. 1 PRIOR ART
FIG. 1 is a cross sectional view of a conventional channel assembly of a nailer.
Figure 2:
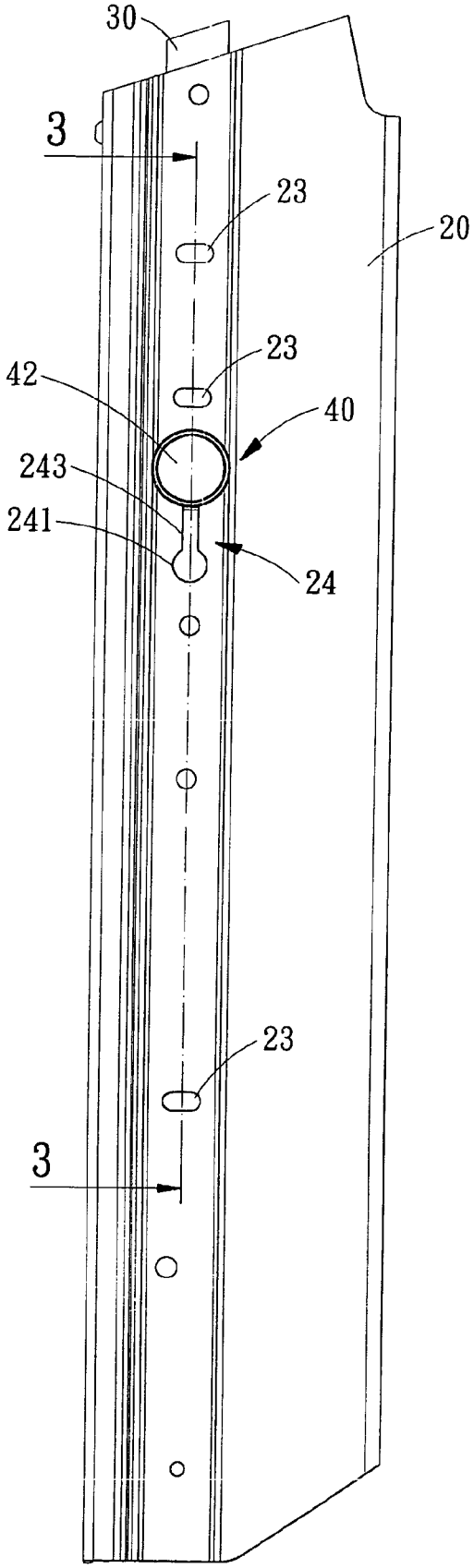
FIG. 2 is a plan view of an apparatus for adjusting width of drive channel of nailer in accordance with the present invention.

Referring first to FIGS. 2–7, an apparatus for adjusting width of drive channel of a power nailer in accordance with the present invention generally comprises a channel assembly 20, a push plate 30, an adjusting bolt 40, a washer 50 and a spring 60, and then is assembled on a power nailer 70.

The channel assembly 20 is fixed on the power nailer 70 and interiorly defined with a track 21 for accommodation of a band of nails 71. On the surface of the channel assembly 20 is provided a long-strip slot 22 which corresponds to the track 21, in the channel assembly 20 are defined a plurality of square-shaped open recesses 23. Above the long-strip slot 22 thereof is defined a groove 24 which is provided at both sides with a first hole 241 and a second hole 242. The first hole 241 and the second hole 242 are connected by a necking groove 243.

The push plate 30 is slidably disposed in the long-strip slot 22 of the channel assembly 20, at a side of the push plate 30 is formed a push surface 31 facing toward the track 21 for pushing the band of nails 71. At another side of the push plate 30 is further provided a plurality of square blocks 32 square-shaped open recesses 23 of the channel assembly 20 with a plurality of square blocks 32 which can be received in the corresponding square-shaped open recesses 23 respectively. Still on the push plate 30 where corresponding to the groove 24 of the long-strip slot 22 is further provided with a locking seat 33 having a threaded hole 331 located corresponding to the groove 24.

The adjusting bolt 40 comprises a rod portion 41 and a push head 42, at the front end of the rod portion 41 is provided with plural threads 411. The diameter of the rod portion 41 is designed in response to that of the necking groove 243 of the groove 24 of the channel assembly 20. The rod portion 41 is screwed in the threaded hole 331 of the locking seat 33 of the push plate 30 by virtue of the threads 411 after passing through the groove 24. Moreover, on the rod portion 41 adjacent to the threads 411 a flange 412 is defined having an external diameter corresponding to the first and second hole 241 and 242 of the groove 24. A peripheral chamfer 413 is defined at the periphery of the flange 412.

The washer 50 is mounted to the rod portion 41 of the adjusting bolt 40 and located between the push head 42 of the adjusting bolt 40 and the external surface of the channel assembly 20. The washer 50 is provided at the center thereof with a through hole 51 for passage of the rod portion 41 and at periphery of the through hole 51 thereof a peripheral chamfer 52 is formed which corresponds to the flange 412 of the rod portion 41.

The spring 60 is mounted to the rod portion 41 of the adjusting bolt 40 and biased between the push head 42 of the adjusting bolt 40 and the washer 50.

Figure 3:
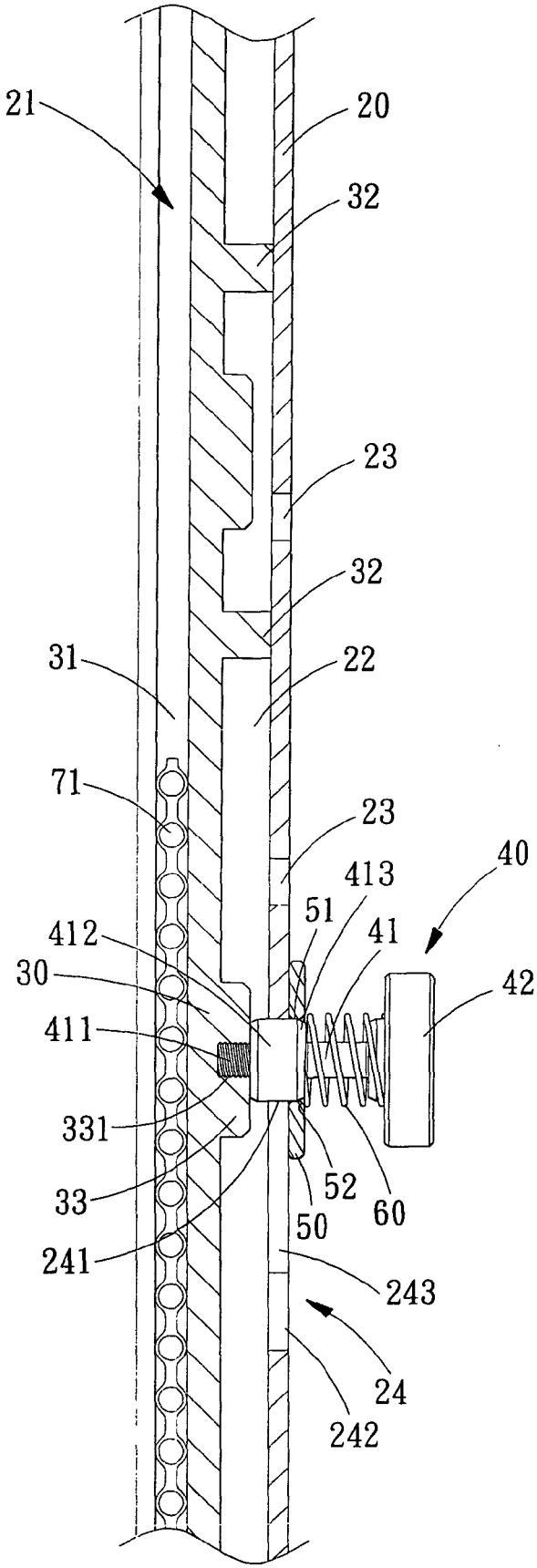
FIG. 3 is a cross sectional view of the apparatus for adjusting width of drive channel of nailer in accordance with the present invention, which being adjusted in a position for accommodating small nails.

Referring specially to FIG. 3, when a band of small nails 71 are applied, the track 21 of the channel assembly 20 serves for receiving the nails 71. The push plate 30 in the long-strip slot 22 will take advantage of the plural blocks 32 to abut against the internal surface of the long-strip slot 22. At this moment, the flange 412 on the rod portion 41 of the adjusting bolt 40 will be positioned in the first hole 241 of the groove 24. Furthermore, the spring 60 will cooperate with the adjusting bolt 40 to enable the push surface 31 of the push plate 30 to position the band of small nails 71 and adjust the width of the track 21 to a moderate extent.

Figure 4:
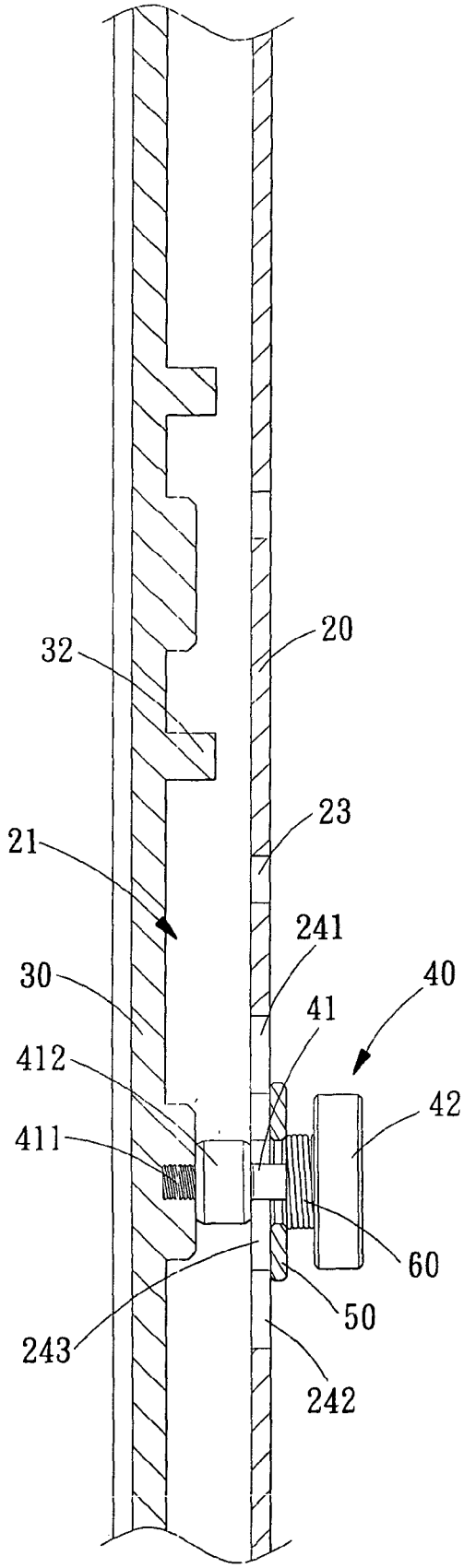
FIG. 4 is another cross sectional view of the apparatus for adjusting width of drive channel of nailer in accordance with the present invention.

Referring further to FIG. 4, when a band of bigger nails 71 are being used, the user can take the band of small nails 71 out first, then push the push head 42 of the adjusting bolt 40 such that the rod portion 41 of the adjusting bolt 40 will push the push plate 30 to the original position of the small nails, as a result, the blocks 32 of the push plate 30 don't abut against the internal surface of the long-strip slot 22 any more and the flange 42 of the rod portion 41 is disengaged from the first hole 241 of the groove 24. At this moment, the minor diameter of the rod portion 41 is exactly the same as that the groove 24, thereby the user may slightly push the adjusting bolt 40 upward so as to make the rod portion 41 enter the necking groove 243 of the groove 24, and the push plate 30 will move synchronously along with the adjusting bolt 40 (the blocks 32 of the push plate 30 will gradually approach the corresponding recesses 23 of the channel assembly 20).

Figure 5:
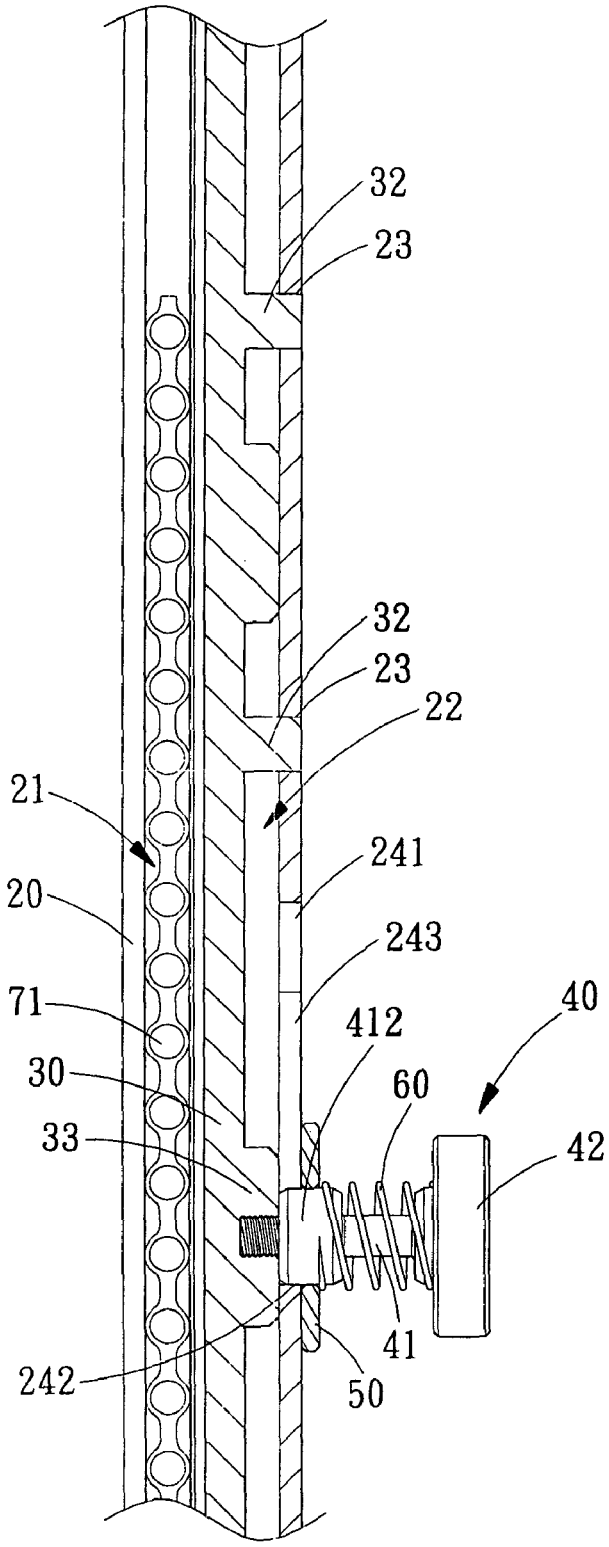
FIG. 5 is a cross sectional view of the apparatus for adjusting width of drive channel of nailer in accordance with the present invention, which being adjusted in a position for accommodating big nails.
Figure 6:
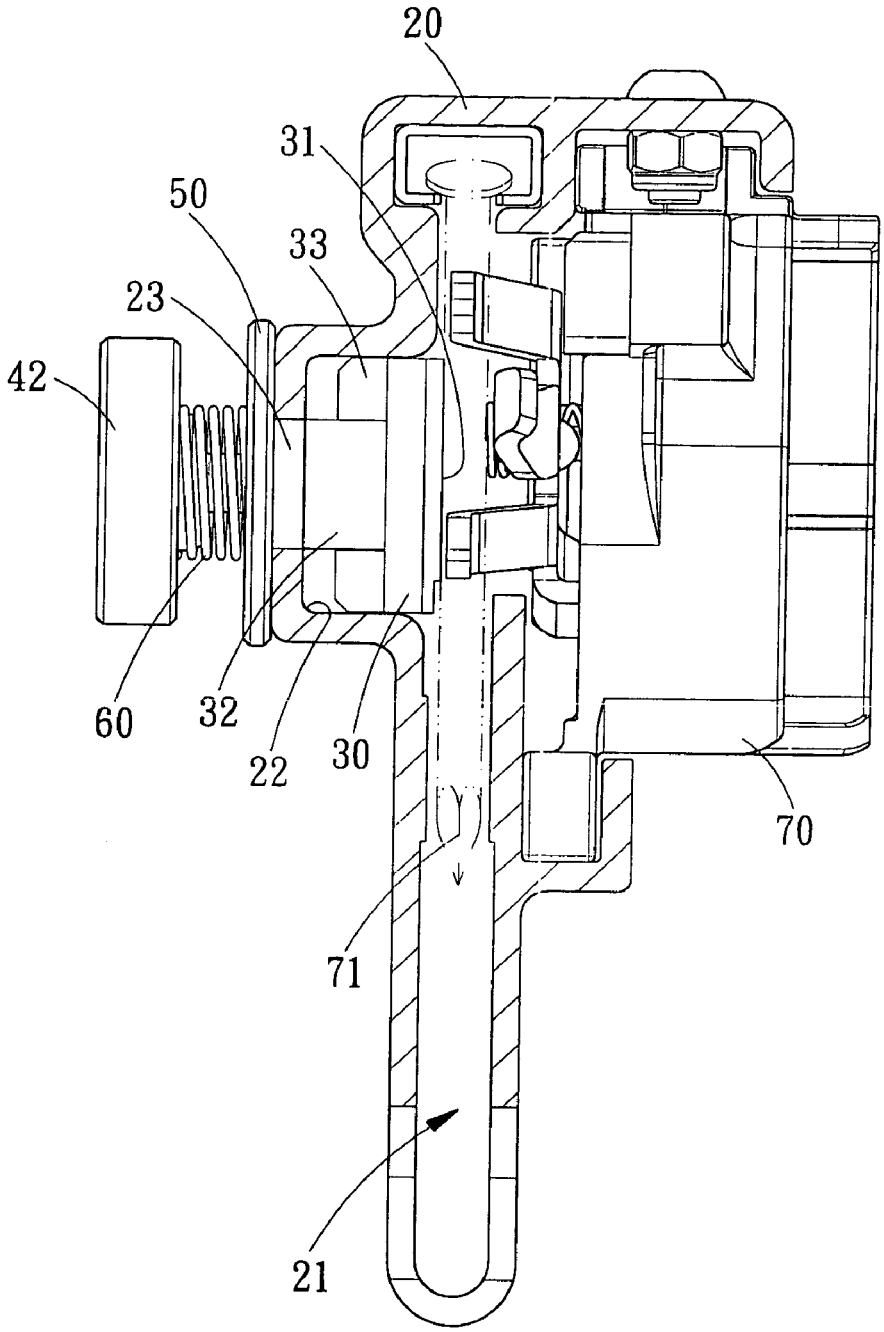
FIG. 6 is a cross sectional view taken from another of the apparatus for adjusting width of drive channel of nailer in accordance with the present invention, which being adjusted in a position for accommodating small nails.
Figure 7:
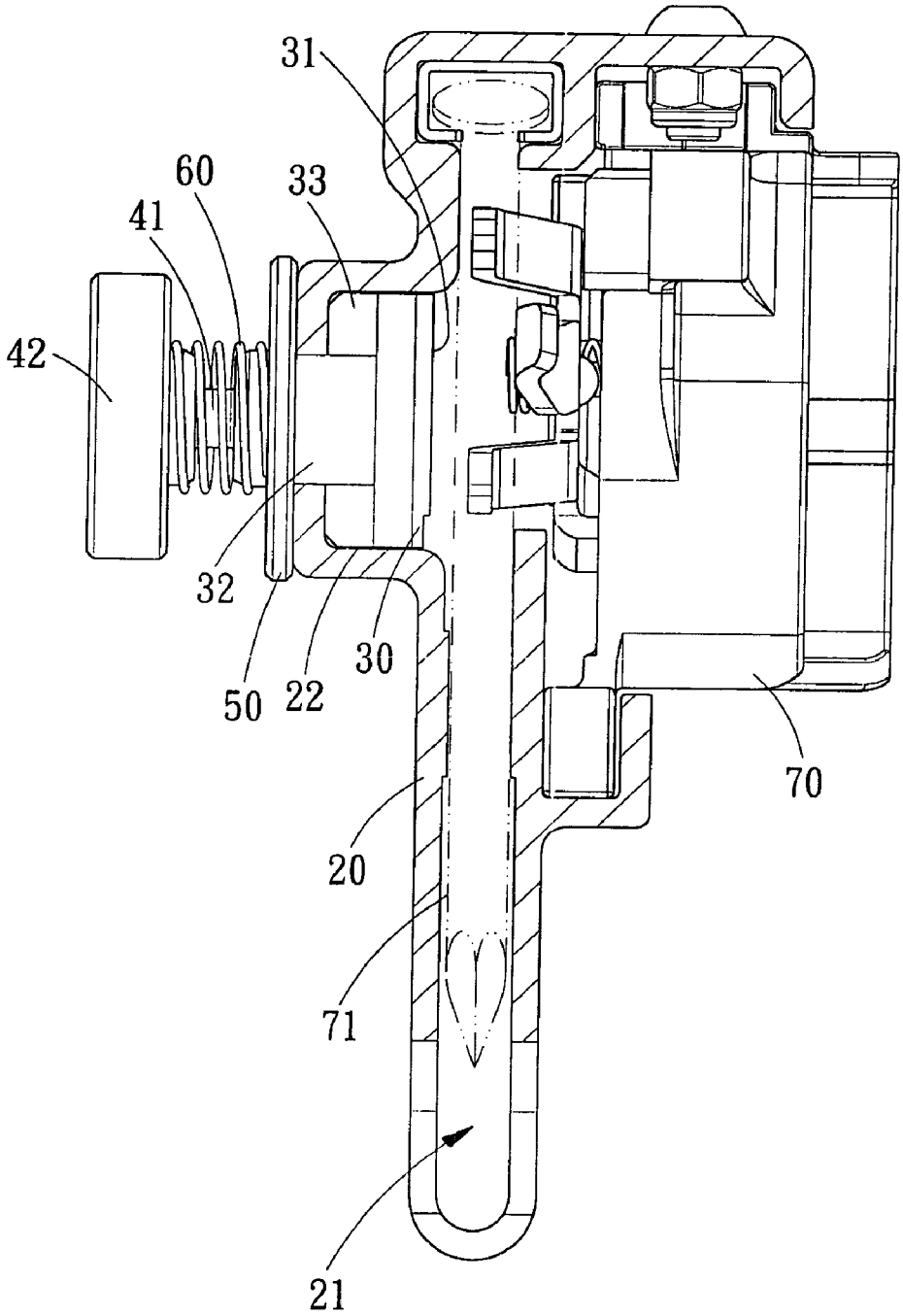
FIG. 7 is a cross sectional view taken from another of the apparatus for adjusting width of drive channel of nailer in accordance with the present invention, which being adjusted in a position for accommodating big nails.

Referring to FIG. 5, by the time the user pushes the rod portion 41 into the second hole 242 of the groove 24, the blocks 32 of the push plate 30 are aligned to the recesses 23 of the channel assembly 20. After the user released his fingers from the adjusting bolt 40, the spring 60 will push the push head 42 of the adjusting bolt 40 outward, and with the cooperation of the peripheral chamfer 413 on the flange 412 of the adjusting bolt 40 and the peripheral chamfer 52 around the through hole 51 of the washer 50, the flange 412 of the adjusting bolt 40 is allowed to enter the second hole 242 of the groove 24. At the same time, the blocks 32 on the push plate 30 are received in the corresponding recesses 23 of the channel assembly 20 respectively. Since the surface of each block 32 is higher than that of the locking seat 33, the push plate 30 in the long-strip slot 22 will be closer to the internal surface of the long strip slot 22 than previous, while the spring 60 will readjust itself to position the adjusting bolt 40, and accordingly the push surface 31 of the push plate 30 leaves more spaces to the track 21. Thereby the track 21 will be larger than before whereby to receive and position band of larger-sized nails 71.

While we have shown and described various embodiments in accordance with the present invention, it should be clear to those skilled in the art that further embodiments may be made without departing from the scope of the present invention.

What is claimed is:

1. An apparatus for adjusting width of drive channel of a nailer comprising:

a channel assembly interiorly defined with a track for accommodation of a band of nailers, on a surface of the channel assembly formed a slot corresponding to a long-strip slot at a side of the track, a plurality of open recesses defined in the slot, above the slot thereof defined with a groove which is provided at both sides with a first hole and a second hole, and a necking groove connected between the first hole and the second hole;

a push plate slidably disposed in the slot of the channel assembly, at a side of the push plate formed a push surface for pushing the nails, and at another side of the push plate provided a plurality of blocks facing toward open recesses of the channel assembly, at the another side of the push plate provided with a locking seat, the locking seat is lower than the blocks;

an adjusting bolt including a rod portion and a push head, a diameter of the rod portion corresponding to a diameter of the necking groove of the groove of the channel assembly, a threaded hole defined in the locking seat of the push plate and located corresponding to the groove, the rod portion formed at its front end with plural threads, the rod portion being screwed in the threaded hole of the locking seat of the push plate, on the rod portion adjacent to the front end thereof defined a flange having an external diameter corresponding to the first and second hole of the groove;

a spring mounted to the rod portion of the adjusting bolt and biased between the push head of the adjusting bolt and external surface of the channel assembly.

2. The apparatus for adjusting width of drive channel of nailer as claimed in claim 1, wherein a washer is disposed between the spring and the external surface of the channel assembly and to be mounted onto the rod portion of the adjusting bolt by virtue of a through hole defined at the center thereof.

3. The apparatus for adjusting width of drive channel of nailer as claimed in claim 2, wherein a chamfer is defined at periphery of the flange of the adjusting bolt, and the through hole of the washer is provided for passage of the rod portion, around the periphery of the through hole is defined another chamfer corresponding to the chamfer of the flange of the rod portion.

* * * * *